United States Patent [19]

Horinouchi

[11] Patent Number: 4,658,186

[45] Date of Patent: Apr. 14, 1987

[54] CONTROL APPARATUS FOR FLUORESCENT DISPLAY TUBE

[75] Inventor: Atsushi Horinouchi, Otsu, Japan

[73] Assignee: Sanyo Electric Co., Japan

[21] Appl. No.: 686,212

[22] Filed: Dec. 26, 1984

[30] Foreign Application Priority Data

Dec. 27, 1983 [JP] Japan ..... 58-252103

[51] Int. Cl.[4] ..... G09G 3/10

[52] U.S. Cl. ..... 315/169.3; 219/10.55 B; 313/513; 313/516; 315/169.1

[58] Field of Search ..... 315/169.3, 169.1, 169.4; 219/10.55 B, 10.55 C; 313/513, 514, 515, 517, 519

[56] References Cited

U.S. PATENT DOCUMENTS

| | | | |
|---|---|---|---|
| 3,629,653 | 12/1971 | Irwin | 315/169.3 |
| 3,723,789 | 3/1973 | Tanji | 313/517 |
| 3,737,707 | 6/1973 | Yanagisawa | 313/519 |
| 3,833,833 | 9/1974 | Nelson | 315/169.3 |
| 4,070,599 | 1/1978 | Uchikoba et al. | 313/315 |
| 4,443,741 | 4/1984 | Tanaka et al. | 315/169.3 |
| 4,504,716 | 3/1985 | Sakamoto | 219/10.55 B |
| 4,517,431 | 5/1985 | Ueda | 219/10.55 B |

*Primary Examiner*—Saxfield Chatmon

*Attorney, Agent, or Firm*—Handal & Morofsky

[57] ABSTRACT

A control apparatus for a fluorescent display tube controls selectively light emission of a plurality of display segments (*7a* to *7g*) provided in a fluorescent display tube (1) so that desired data may be displayed. This apparatus is for example combined with a microwave oven, so as to display the cooking time or the remaining cooking time required for control of the microwave oven or to display the present time of day or other data. Among the display segments (*7a* to *7g*), at least the display segments emitting light relatively less frequently are forced to emit light with predetermined timing, for example, each time cooking operation is ended, whereby irregularities in the frequency for light emission among the display segments (*7a* to *7g*) can be avoided. As a result, no difference is caused in the display brightness in the respective display segments (*7a* to *7g*) and accordingly, clearly visible display can be made.

12 Claims, 17 Drawing Figures

FIG. 4

(a) 5:00

(b) 4:59

(c) 4:58

FIG. 5

30

FIG. 6

(a) 24:30

(b) 35:40

End

CONTROL APPARATUS FOR FLUORESCENT DISPLAY TUBE

BACKGROUND OF THE INVENTION

1. Field of the Invention

The present invention relates to a display control apparatus for a fluorescent display tube to be utilized for display. More particularly, the present invention relates to a display control apparatus for a fluorescent display tube suited to be combined with electronic apparatus provided with a fluorescent display tube such as microwave ovens and the like.

2. Description of the Prior Art

Fluorescent display tubes are widely utilized in various electronic and electric apparatus. In their utilization of interest to the present invention, such fluorescent display tubes are controlled so that operating procedure or operating state and other data are displayed when the apparatus is in operation, and the time, for example, is displayed when the apparatus is not operated.

A structure of such a fluorescent display tube is described for example in the U.S. Pat. No. 3,723,789. The present invention is directed to a display control apparatus for controlling the above described well known fluorescent display tube in a desired state.

A prior art display control apparatus of interest is described in the following by taking an example of a microwave oven controlled by a microcomputer.

FIG. 1 is a circuit diagram of a fluorescent display tube 1 utilized in a microwave oven. FIG. 2 is a front view showing the arrangement of the display segments of the fluorescent display tube 1.

Referring to FIGS. 1 and 2, the fluorescent display tube 1 comprises a colon segment luminescent portion 2 and four numeral luminescent portions 3, 4, 5 and 6, each portion being coated with a fluorescent material. The numeral luminescent portions 3 to 6 each comprises seven segments *7a*, *7b*, *7c*, *7d*, *7e*, *7f* and *7g*. The colon segment luminescent portion 2 and the four numeral luminescent portions 3 to 6 are structured as anodes of the fluorescent display tube 1. The fluorescent display tube 1 further comprises grids 8, 9, 10, 11 and 12 corresponding to the luminescent portions 2 to 6 respectively and one filament 13. In the fluorescent display tube 1 thus structured, a predetermined voltage is applied selectively between the grids 8 to 12 and the colon segment luminescent portion 2 and the seven segments *7a* to *7g* of the numeral luminescent portions 3 to 6, respectively, so that electrons emitted from the filament 13 are applied selectively to the colon segment luminescent portion 2 and respective seven segments *7a* to *7g* of the numeral luminescent portions 3 to 6. Thus, desired data is displayed by emission of fluorescent light through the luminescent portions 2 to 6.

In the case of the fluorescent display tube 1 provided in a microwave oven controlled by a microcomputer, the present time is generally displayed when cooking operation is not performed, and for cooking operation, the cooking time set by a user and the remaining time after the start of the cooking operation, the output of the microwave oven as well as other necessary data set by the user such as the maximum cooking temperature and the like are suitably displayed.

In such a case, the present time is displayed by the expression for twelve hours. More specifically, the display in the fluorescent display tube 1 changes successively for each minute from the state of "1:00" representing just one o'clock as shown in FIG. 3(*a*) to the state of "12:59" representing fifty-nine minutes past twelve o'clock as shown in FIG. 3(*b*).

If the cooking time is for example just five minutes, a display of "5:00" as shown in FIG. 4(*a*) is given to the fluorescent display tube 1 and after the cooking is started, the display in the fluorescent display tube 1 changes successively for each second to "4:59", then to "4:58" as shown in FIGS. 4(*b*) and 4(*c*) and the cooking is completed with the display of "0".

The display of the output of the microwave oven is given as an arbitrary percentage set by the user. For example, as shown in FIG. 5, a display of "30" is given to represent 30%.

Now, for the purpose of clarifying the problems the present invention intends to solve, detailed description will be made of the light emitting frequency of the respective segments *7a* to *7g* in the numeral luminescent portion 3 of the most significant digit in the above described fluorescent display tube 1.

For the display of the present time, the numeral luminescent portion 3 of the most significant digit emits light only in the period from ten o'clock to fifty-nine minutes past twelve and in this period, only the segments *7f* and *7g* representing the numeral "1" emit light.

As for the display of the set cooking time, the cooking time of an electronic cooking range is generally several minutes. In this case, the set cooking time and the remaining cooking time can be displayed only by means of the numeral luminescent portions 4, 5 and 6 of the less significant three digits as shown in FIGS. 4(*a*) to 4(*c*), and the numeral luminescent portion 3 of the most significant digit is generally not used. However, in a very rare case, cooking operation is performed for as long as several tens of minutes and in such a case, a display of "24:30" or "35:40" is given to represent the remaining time of 24 minutes 30 seconds or 35 minutes 40 seconds, for example, as shown in FIG. 6(*a*) and or 6(*b*), and the numeral luminescent portion 3 of the most significant digit is also used.

For the display of the cooking output, the user can set the output value from 0 to 100% in an arbitrary manner and the set value is displayed by means of the numeral luminescent portions 4, 5 and 6 of the less significant three digits in the fluorescent display tube 1. Accordingly, in this case, the numeral luminescent portion 3 of the most significant digit is not used at all.

As is understood from the above description, although the numeral luminescent portion 3 of the most significant digit, and more particularly the segments *7f* and *7g* thereof occasionally emit light for the display of the time, the other segments *7a* to *7e* of the luminescent portion 3 seldom or very rarely emit light.

However, consumers complain that they cannot easily read the displayed data in such segments as the segments *7a* to *7e* of the luminescent portion 3 with low frequency of light emission where light is very rarely emitted, because the brightness of the light emitted by the segments *7a* to *7e* of the luminescent portion 3 is lowered as compared with the brightness of the light in the other segments *7f* and *7g* of the luminescent *7g* of the luminescent portions 4, 5 and 6 of the less significant three digits.

As a result of investigation, the causes thereof can be explained as follows. In the fluorescent display tube 1, remaining gas exits. When electrons are emitted from the filament 13 of the fluorescent display tube 1, barium gas and the like are generated from the filament 13. In addition, gas containing suspended matter is generated by collision of the emitted electrons from the filament 13 with the respective luminescent portions 2 to 6 and the grids 8 to 12. These gases tend to accumulate one after another in the luminescent material of the colon segment luminescent portion 2 as well as in the luminescent material of the numeral luminescent portions 3 to 6 as the time passes.

However, if the segments to which the gases move to accumulate emit light occasionally, electrons are applied from the filament 13 to such segments each time the segments emit light. Accordingly, in such segments occasionally emitting light, the gases moved thereto are scattered each time and accumulation of gases in such segments hardly occurs.

On the other hand, electrons are rarely applied to the segments emitting light with extremely low frequency such as the above described specified segments *7a* to *7e* of the numeral luminescent portion 3 of the most significant digit. Accordingly, in these segments, accumulation of gases proceeds rapidly.

The segments *7a* to *7e* of the luminescent portion 3 containing thus accumulated gases have an extremely lowered brightness as compared with the other segments. As a result, if data, for example, the remaining time in a long period of cooking is displayed using both the segments not containing accumulated gases and the segments containing accumulating gases, a considerably large difference is caused in the luminescent brightness in the segments, and the display becomes extremely hard to see.

For this reason, in case of using the fluorescent display tube 1 for display of data, all the segments could be made to emit light forcedly for example, for each predetermined interval. In consequence, the above described accumulation of gases would not occur and there would not be a difference in the luminescent brightness in the segments. However, in such a case, there are new problems that the user may often regard the display device as malfunctioning or he may often think erroneous data to be correct by seeing the display forcedly made.

SUMMARY OF THE INVENTION

A primary object of the present invention is to provide a display control apparatus for a fluorescent display tube in which there is no inequality in the luminescent brightness of a fluorescent display tube so that displayed data can be read easily.

Another object of the present invention is to provide a display control apparatus for a fluorescent display tube in which display in a fluorescent display tube is given forcedly and control is made so that the forcedly given display may not be regarded as an erroneous display.

Briefly stated, the present invention comprises a display control apparatus in which desired data is displayed by controlling selectively the light emission of arbitrary segments among a plurality of fluorescent segments provided in a fluorescent display tube so that at least the segments emitting light relatively less frequently may be formed to emit light at each predetermined timing.

Accordingly, in the present invention, since the segments emitting light relatively less frequently are forced to emit light at each predetermined timing, accumulation of gases does not occur in these segments and the luminescent brightness in these segments can be prevented from being lowered as compared with the luminescent brightness in the other segments.

In a preferred embodiment of the present invention, the predetermined timing for forcedly emitting light is applied to a microwave oven each time the cooking is completed. The predetermined timing is applied to the time display at every 12 a.m. for example when the user and other persons seldom see the time display.

Thus, the user can never obtain erroneous data from the forcedly given luminescent display.

These objects and other objects, features, aspects and advantages of the present invention will become more apparent from the following detailed description of the present invention when taken in conjunction with the accompanying drawings.

BRIEF DESCRIPTION OF THE DRAWINGS

FIGS. 3, 4, 5 and 6, respectively show the states of display in the fluorescent display tube utilized in the above mentioned microwave oven;

DETAILED DESCRIPTION OF THE PREFERRED EMBODIMENTS

In the following, a preferred embodiment of the present invention will be described in detail with reference to the drawings.

Figure 1:
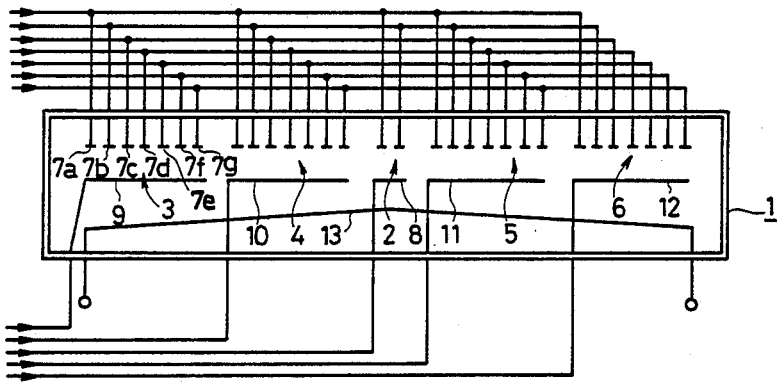
FIG. 1 is a circuit diagram of a fluorescent display tube to be utilized in a microwave oven.
Figure 2:
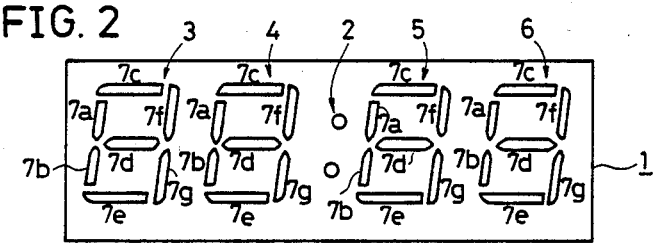
FIG. 2 is a front view showing arrangement of the display segments of the fluorescent display tube in FIG. 1.
Figure 3:
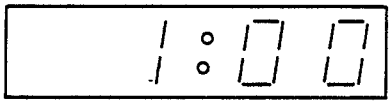
Figure 3:
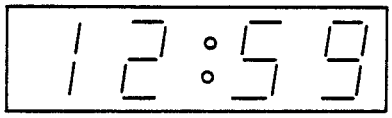
Figure 7:
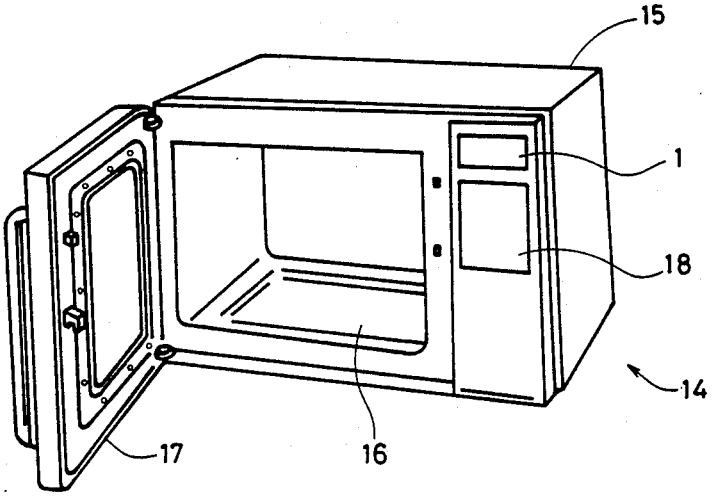
FIG. 7 is a respective view of a microwave oven to which an embodiment of the present invention is applied.

FIG. 7 shows appearance of an electronic cooking range to which an embodiment of the present invention is applied. Operation of this electronic cooking range 14 is controlled by a microcomputer. A body 15 is provided with a heating chamber 16 for containing food. A front opening of the heating chamber 16 is opened and closed by a door 17. On the right side of the front face of the body 15, a keyboard 18 having various keys and a fluorescent display tube 1 for display of various data are provided.

Figure 8:
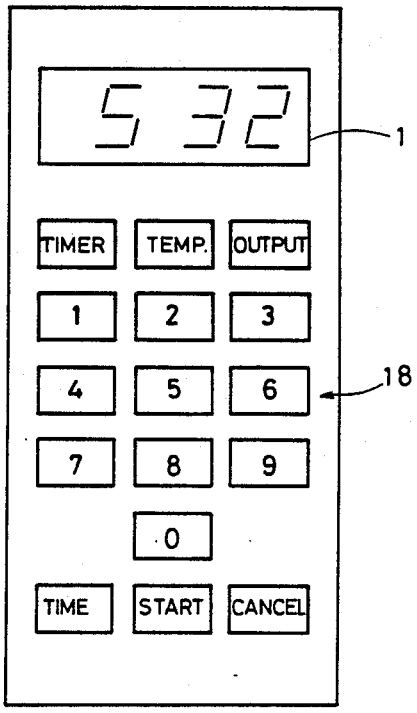
FIG. 8 is a front view of an essential portion of the electronic cooking range in FIG. 7.

FIG. 8 is a plan view showing in a concrete manner the arrangement of the keys of the keyboard 18 and the structure of the fluorescent display tube 1. As shown in FIG. 8, the keyboard 18 comprises numeric keys of "1" to "9" and "0", a "timer" key, "temperature" key, an "output" key, a "time" key, a "start" key and a "cancel" key. The numeric keys serve to enter data of numerical values. The "timer" key serves to set the cooking time. The "temperature" key serves to set the maximum cooking temperature for cooking the food. The "output" key serves to set an output for cooking of the electronic cooking range 14. The "time" key serves to set or correct the time displayed by the fluorescent display tube 1 in a standby mode. The "start" key serves to start control operation in the respective modes. The "cancel" key serves to cancel or stop the set data or control operation.

Figure 9:
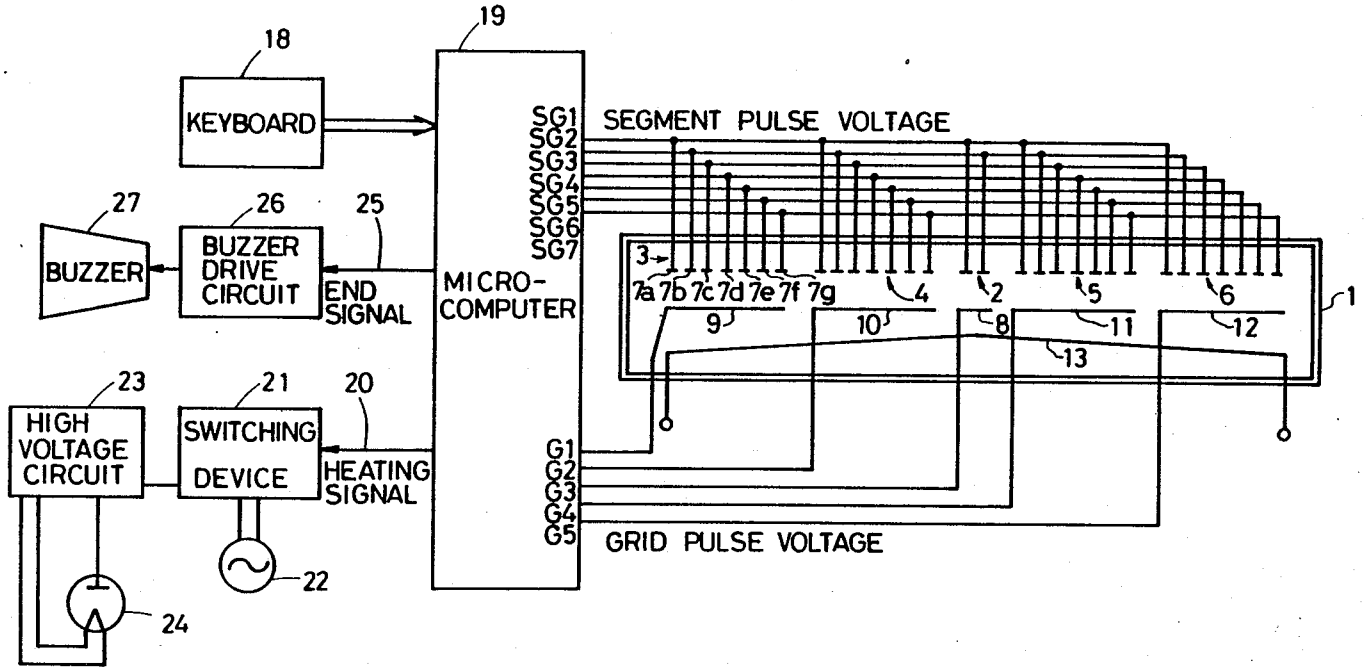
FIG. 9 is a block diagram showing the electronic circuit structure of the FIG. 7 microwave oven.

FIG. 9 is a block diagram showing a circuit structure of the electronic cooking range 14. Referring to FIG. 9, the circuit of the electronic cooking range 14 includes a microcomputer 19 as the control center. The microcomputer 19 controls heating operating and the like for various cooking processes based on the data of the cooking period, the output, the temperature etc. entered by means of the keyboard 18.

When a heating signal 20 is provided from the above described microcomputer 19, a switching circuit 21 comprising a bipolar thyristor and the like is turned on and electric power is supplied from a commercial power source 22 to a high voltage circuit 23. As a result, high voltage is applied from the high voltage circuit 23 to a magnetron 24. Then, microwave is supplied from the magnetron 24 to the heating chamber 16 so that microwave heating is performed.

When an end signal 25 is provided from the microcomputer 19, a buzzer driving circuit 26 operates so that a buzzer 27 sounds.

Furthermore, the microcomputer 19 controls the fluorescent display tube 1 so that various data such as the present time, the cooking time and the remaining time, the output, the temperature etc. are suitably displayed in the fluorescent display tube 1. The structure of the fluorescent display tube 1 is the same as that of the above described conventional fluorescent display tube and, therefore, detailed description thereof is omitted, the identical portions being designated by the identical reference characters.

Now, detailed description will be made of the control operation by the microcomputer 19 for display of the fluorescent display tube 1 which constitutes the main feature of this embodiment.

The microcomputer 19 applies selectively predetermined grid pulse voltages G1 to G5 to the grids 8 to 12 of the fluorescent display tube 1, respectively. In synchronism with the arbitrary application of the grid pulse voltages G1 to G5, the microcomputer 19 applies selectively predetermined segment pulse voltages SG1 to SG7 to the segments *7a* to *7g* of the colon segment luminescent portion 2 and the numeral luminescent portions 3 to 6.

Figure 10:
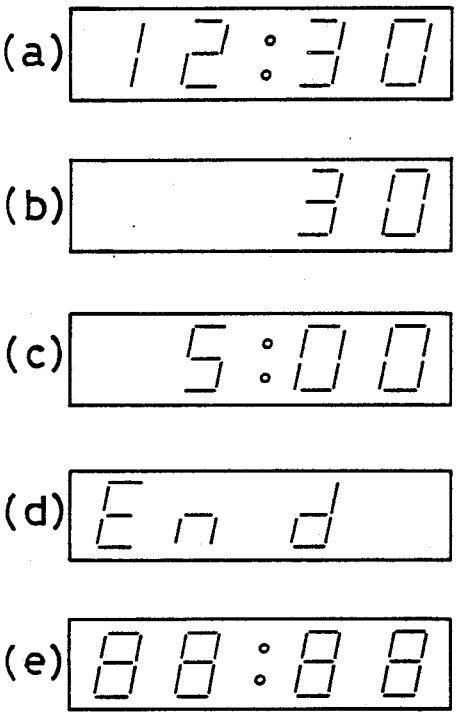
FIG. 10 shows the states of display in a fluorescent display tube of an embodiment of the present invention.

In such a structure, the microcomputer 19 controls, in the below described manner, the application of the grid pulse voltages G1 to G5 and the segment pulse voltages SG1 to SG7 so that the fluorescent display tube 1 gives a display of "12:30" representing 30 minutes past twelve as shown in FIG. 10(*a*) for example. First, the microcomputer 19 provides grid voltage G1 and in synchronism therewith provides segments pulse voltages SG6 and SG7. Then, electrons from the filament 13 are selectively applied only to the segments *7f* and *7g* of the numeral luminescent portion 3 of the most significant digit of the fluorescent display tube 1 and, as a result, fluorescent light is emitted to represent the numeral "1" in the numeral luminescent portion 3. Subsequently the microcomputer 19 provides grid pulse voltage G2 and in synchronism therewith provides segment pulse voltages SG2 to SG6. Then, in the same manner, fluorescent light is emitted in the numeral luminescent portion 4 of the more significant second digit to represent the numeral "2". Subsequently, the microcomputer 19 provides grid pulse voltage G3 and segment pulse voltages SG1 and SG2 for the colon segment luminescent portion to emit light representing the colon ":" and provides grid pulse voltage G4 and segment pulse voltages SG3 to SG7 for the numeral luminescent portion 5 of the less significant second digit to emit light representing the numeral "3" and also provides grid pulse voltage G5 and segment pulse voltages SG1 to SG3 and SG5 to SG7 for the numeral luminescent portion 6 of the least significant digit to emit light representing the numeral "0". Thus, the microcomputer 19 repeats the above described sequence of control operation for light emission with high speed and, as a result, it appears to the user due to the phenomenon of after-image that a display of "12:30" as shown in FIG. 10(*a*) is given in the fluorescent display tube 1.

In the same manner, a display of "30" representing an output of 30% of the electronic cooking range or a display of "5:00" representing the cooking period of 5 minutes, for example, as shown in FIG. 10(*b*) or 10(*c*) can be made by control of the microcomputer 19.

This embodiment is characterized in that a display of "End" as shown in FIG. 10(*d*) is given with predetermined timing by control of the above described microcomputer 19 using the numeral luminescent portions 3 to 5 of the more significant three digits. More specifically, this embodiment is characterized in that a display of "End" is made with predetermined timing so that light emission for display is forcedly made in the display segments *7a* to *7e* of the numeral luminescent portion 3 of the most significant digit relatively less frequently utilized to emit light.

In the following, in order to clearly explain the display timing of the above described forced display of "End", operation of the electronic cooking range 14 will be described for each mode with reference to the flow charts.

Figure 11:
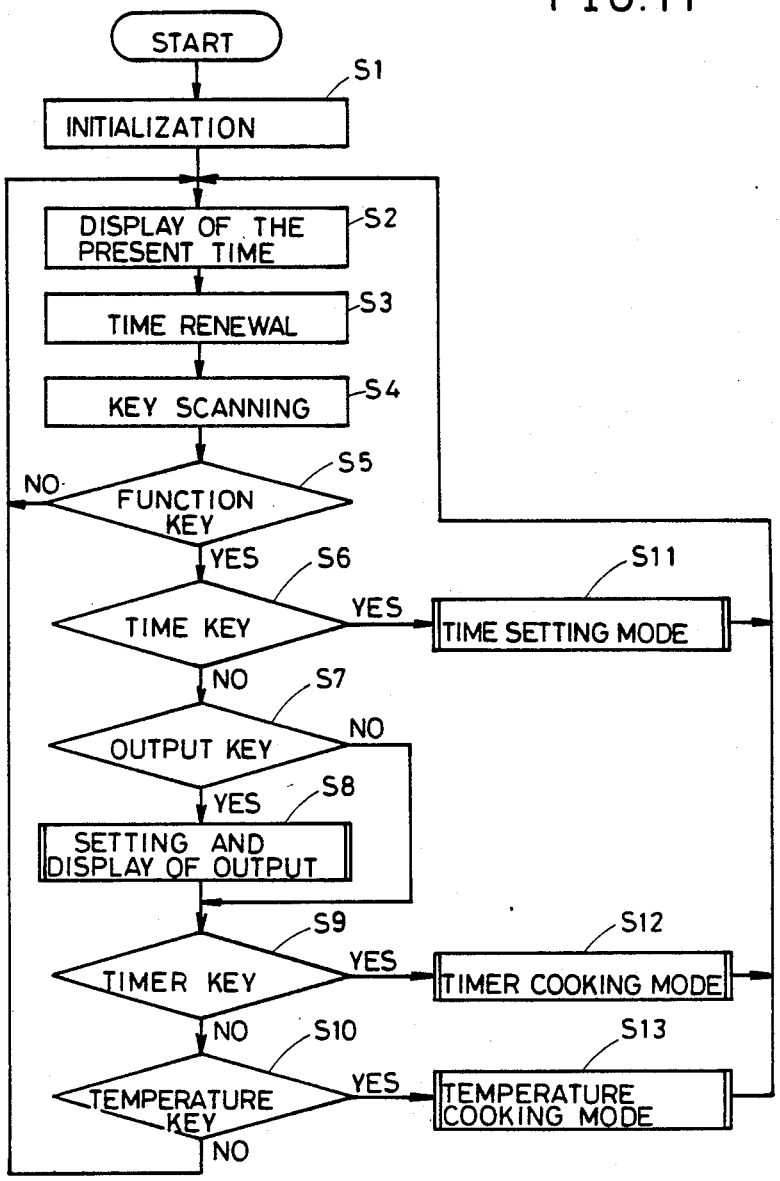
FIG. 11 is a flow chart showing a control operation of the microcomputer 19 in the standby state.

FIG. 11 is a flow chart showing control operation of the microcomputer 19 in the standby state. Referring to FIG. 11, when the power source of the electronic cooking range 14 is turned on, the microcomputer 19 initializes the data (in step S1) and the program circulates normally in steps S2 to S5. More specifically, in step S2, the microcomputer 19 provides selectively the grid pulse voltages G1 to G5 and the segment pulse voltages SG1 to SG7 so that the fluorescent display tube 1 emits light to represent the time. In step S3, the time is renewed for each minute. In step S4, the keys of the keyboard 18 are scanned and in step S5, it is determined whether a function key (a key other than the numeric keys) is pressed or not.

As for the state of display in the fluorescent display tube 1 during the circulation of the above described steps S2 to S5, a display of the time is given for one cycle of circulation, each time the program comes to step S2. Such display of the time is repeatedly made for each cycle of circulation of the steps S2 to S5, and this repetition is made with such a high speed in this case that appears to the user as if the time were displayed substantially without interruption, due to the phenomenon of after-image.

Subsequently, in step S5, if the microcomputer 19 determines that a function key is pressed, it is determined whether the pressed function key is the "time" key, the "output" key, the "timer" key or the "temperature" key (in steps S6, S7, S9 and S10). If the function key is the "time" key, the control operation proceeds to the time setting mode (in step S11). If it is the "output" key, the data, for example "30", entered by the numeric keys is subsequently set as the output data and the set output data "30" as the output is 30% is displayed in the fluorescent display tube 1. Then, the "timer" key or the "temperature" key is normally pressed and the program proceeds to the timer cooking mode or the temperature cooking mode (in step S12 or step S13).

Figure 12:
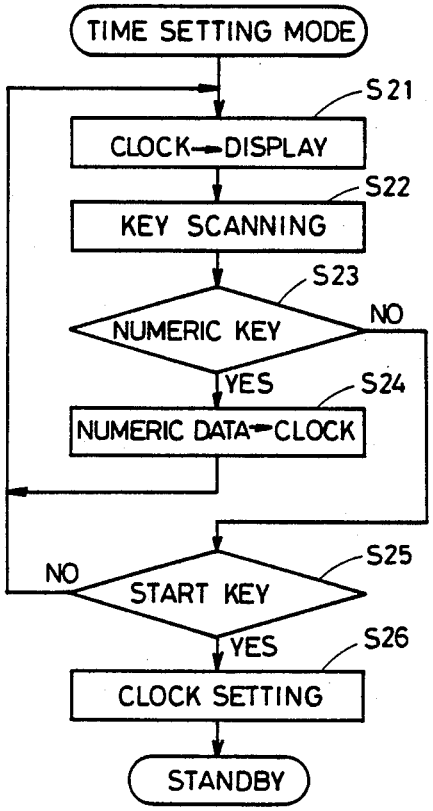
FIG. 12 is a flow chart showing a control operation of the time setting mode.
Figure 13:
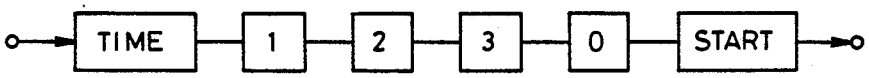
FIG. 13 shows a key sequence for setting the present time in the time setting mode.

FIG. 12 is a flow chart showing control operation of the time setting mode and FIG. 13 shows a key sequence corresponding to the flow chart in FIG. 12. Referring to FIGS. 12 and 13, operation of the microcomputer 19 in the time setting mode will be described.

In order to set the present time, for example 30 minutes past twelve as shown in FIG. 10(*a*) after the "time" key of the keyboard 18 is pressed, the numeric keys of "1", "2", "3" and "0" are successively pressed. Then, the operation of the microcomputer 19 circulates in steps S21 to S24 so that the numeric data entered by means of the above stated numeric keys are set as the clock data and display thereof is made in the fluorescent display tube 1 by shifting them from the least significant digit to the more significant digits. Finally, the fluorescent display tube 1 displays "12:30". After that, the microcomputer 19 determines that the "start" key is pressed (in step S25) and then sets the above described displayed time as the present time and returns to the standby state as shown in FIG. 11 so that the present time is renewed by circulation in steps S2 to S5.

Figure 14:
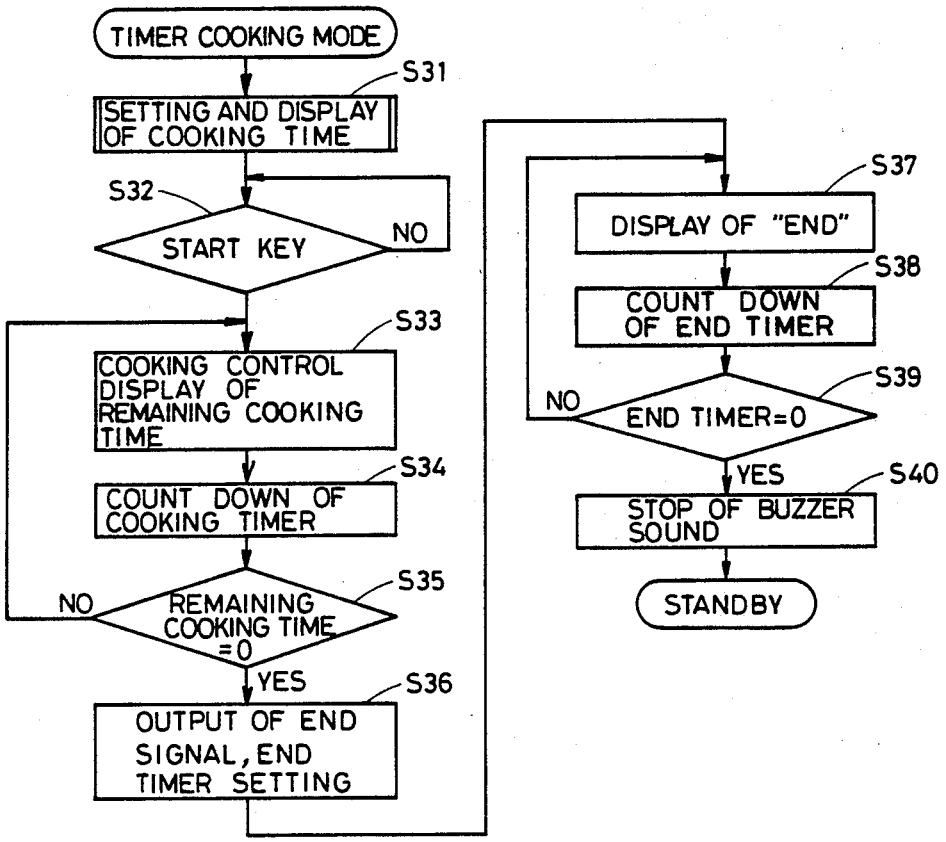
FIG. 14 is a flow chart showing the timer cooking mode.

The timer cooking mode will be described. FIG. 14 is a flow chart showing the timer cooking mode and FIG. 15 shows a key sequence for setting the cooking time in the timer cooking mode.

Figure 15:
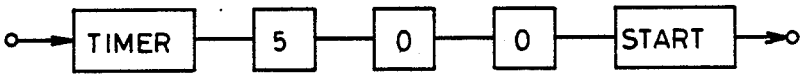
FIG. 15 shows a key sequence for setting the cooking time in the timer cooking mode.

Referring to FIGS. 14 and 15, when the "timer" key is pressed, control operation of the microcomputer 19 proceeds to the timer cooking mode. In this mode, the microcomputer 19 effaces the display of the present time in the fluorescent display tube 1 and sets the numeric data entered by means of the numeric keys as the cooking time data so that the set time is displayed in the fluorescent display tube 1 (in step S31). For example, if the cooking time of 5 minutes is entered, the numeric keys of "5", "0" and "0" are successively pressed as shown in FIG. 15 after the "timer" key is pressed. In consequence, the microcomputer 19 sets the cooking time of 5 minutes and makes the display of "5:00" in the fluorescent display tube 1.

Then, the "start" key of the keyboard 18 is pressed and when the microcomputer 19 determines that the "start" key is pressed (in step S32), control operation of the microcomputer 19 circulates in steps S33 to S35 so that cooking operation is controlled and that the remaining cooking time is displayed. More specifically, in step S33, the microcomputer 19 performs cooking operation by microwave heating and at the same time controls the display of the remaining cooking time. In this case, if the output of the electronic cooking range is set to 30%, the microcomputer 19 provides a heating signal 20 (see FIG. 9) to supply microwave for three seconds with a cycle of 10 seconds so that cooking operation is controlled. In step S34, the remaining cooking time counts down for each second. The remaining cooking time thus counting down for each second is displayed each time the program comes to the step S33, till the time becomes 0 (zero).

When the remaining cooking time becomes 0, namely, when the microcomputer 19 determines that the cooking operation for the set time, for example 5 minutes is completed (in step S35), operation of the microcomputer 19 gets out of the circulation in steps S33 to S35 and proceeds to step S36. In step S36, the microcomputer 19 starts to apply an end signal 25 as shown in FIG. 9 and in consequence the buzzer 27 starts to sound. At the same time, the microcomputer 19 sets the end timer so as to set the end announcing time for example 2 seconds. Then, control operation circulates in the program of steps S37 to S39. In step S37, the microcomputer 19 gives a luminescent display of "End" once as shown in FIG. 10(*d*) using the numeral luminescent portions 3 to 5 of the more significant three digits of the fluorescent display tube 1. In step S38, the end timer is made to count down and in step S39, it is determined whether the count of the end timer becomes 0 or not, namely, whether the end announcing time for example 2 seconds have passed or not after setting of the end timer. When the count of the end timer becomes 0, the program proceeds to step S40, where the microcomputer 19 stops application of the end signal 25 and the buzzer 27 stops sounding.

In the following, the display of "End" which constitutes one of the characteristics of this embodiment will be described more specifically.

Figure 16:
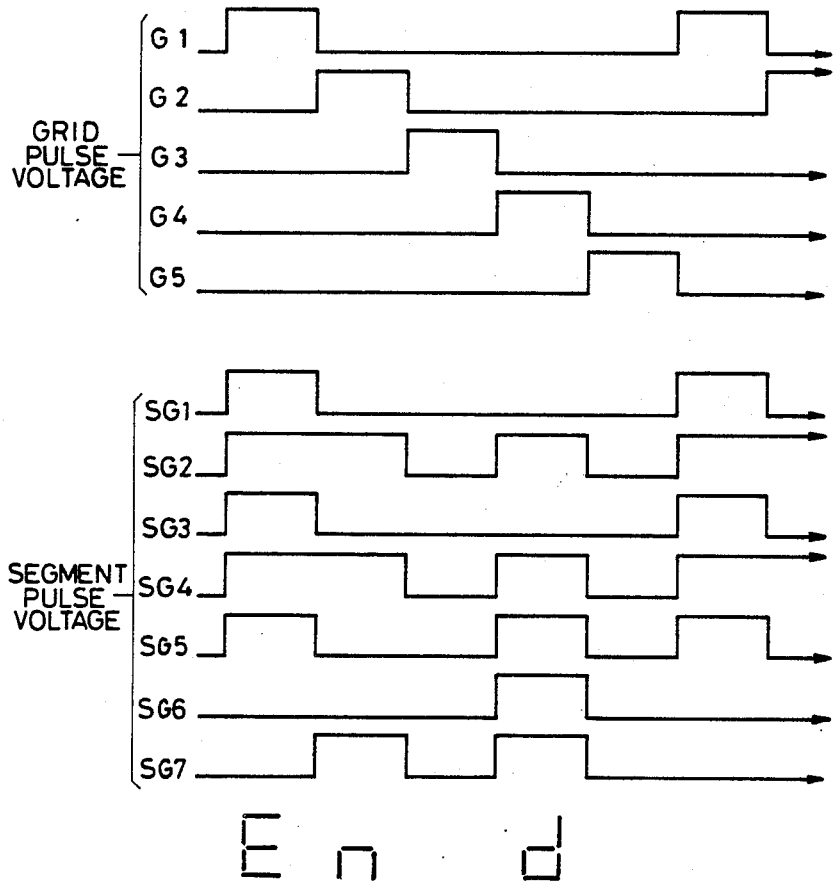
FIG. 16 is a timing chart showing waveform is of the pulse voltages supplied to the fluorescent display tube for displaying "End"

FIG. 16 is a timing chart showing output waveforms of the grid pulse voltages G1 to G5 and the segment pulse voltages SG1 to SG7 provided from the microcomputer 19. Referring mainly to FIGS. 9, 14 and 15, in step S37, the microcomputer 19 first provides grid pulse voltage G1 to display "End" in the fluorescent display tube 1. At the same time, in synchronism with the application of the voltage G1, the microcomputer 19 provides segment pulse voltages SG1 to SG5. As a result, electrons from the filament 13 of the fluorescent display tube 1 are selectively applied only to the segments *7a* to *7e* of the numeral luminescent portion 3 of the most significant digit. In consequence, the numeral luminescent portion 3 of the most significant digit displays "E". Subsequently, the microcomputer 19 provides grid pulse voltage G2 and in synchronism therewith provides segment pulse voltages SG2, SG4 and SG7. As a result, in the same manner, the numeral luminescent portion 4 of the more significant second digit emits fluorescent light to represent "n". Subsequently, the microcomputer 19 provides grid pulse voltage G3. However, in synchronism therewith, none of the segment pulse voltages SG1 to SG7 is provided and the colon segment luminescent portion 2 does not emit light. When grid pulse voltage G4 is provided, segment pulse voltages SG2 and SG4 to SG7 are provided in synchronism and fluorescent light representing "d" is emitted in the numeral luminescent portion 5 of the more significant third digit. The, grid pulse voltage G5 is provided and in synchronism therewith, none of the segment pulse voltages SG1 to SG7 is provided.

The output control of the grid pulse voltages G1 to G5 and the segment pulse voltages SG1 to SG7 by the microcomputer 19 is made each time the program comes to step S37, with the above described sequential operation being regarded as one cycle. As a result, due to the phenomenon of after-image, it appears to the user as if the display of "End" were made substantially without interruption.

As described above, in this embodiment, the luminescent display of "End" is made by means of the more significant three digits in the fluorescent display tube 1 with predetermined timing, namely each time cooking operation is completed. For this luminescent display, the segments emitting light with relatively far less frequency among the luminescent portions constituting the fluorescent display tub 1, namely, the segments *7a* to *7e* of the numeral luminescent portion 3 of the most significant digit are forced to emit light representing the character "E" of the characters "End".

By the above described emission of light representing "E", the light emitting frequency of the segments *7a* to *7e* of the numeral luminescent portion 3 of the most significant digit is comparatively increased and, as a result, accumulation of gases does not occur in the segments *7a* to *7e* of the luminescent portion 3. Accordingly, the brightness in the respective luminescent portion 2 to 6 in the fluorescent display tube 1 can be maintained uniform.

Since the luminescent display of "End" given for each end of cooking operation is a display signifying an end of cooking operation, there is no fear that the use regards the above described forced display as an indication of an incident in the fluorescent display tube 1 or as erroneous data.

In the foregoing, control operation in the timer cooking mode was described. Almost the same control operation is performed in the temperature cooking mode as well. More specifically, in the temperature cooking mode, the maximum cooking temperature is set in the same manner instead of setting and measuring the cooking time for controlling the cooking operation during the set time. Accordingly, in the temperature cooking mode, a temperature probe included a thermistor for example is inserted in the food to be cooked so that the temperature of the food is measured, and when the temperature attains a predetermined temperature, 160° F. for example, control is made to end the cooking operation. Then, control for display of "End" in the fluorescent display tube 1 is performed after the end of the cooking in the exactly same manner as in the steps S36 to S40 in the timer cooking mode.

Figure 17:
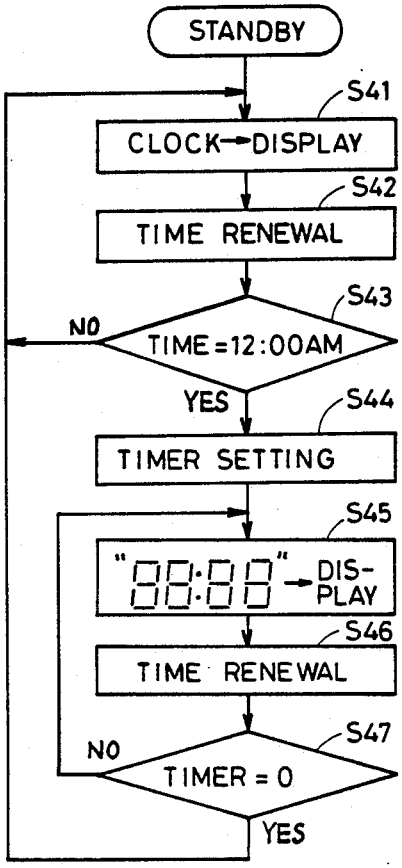
FIG. 17 is a flow chart showing a control program for making forced display at every predetermined time of the standby mode (the time display mode).

FIG. 17 is a flow chart showing another control program for making forced display using the display segments emitting light relatively less frequently compared with the other segments in the fluorescent display tube 1. This control program shown in FIG. 17 is characterized in that control operation is performed to force all the display segments to emit light for a predetermined period, 5 seconds for example, with predetermined timing, namely, at every predetermined time, for example, at 12 o'clock a.m. every day.

Referring to FIG. 17, the microcomputer 19 in the standby state makes control to display the present time in the fluorescent display tube 1. More specifically, the program circulates in steps S41 to S43 so that the present time is displayed in the fluorescent display tube 1.

Then, in step S43, when the microcomputer 19 determines that it is 12 o'clock a.m., the program departs from the circulation in steps S41 to S43 to advance to step S44. In step S44, the timer is set to a period of 5 seconds for example. In steps S45 to S47, all the display segments emit light to make a display of "88:88" until the count of the timer becomes 0, namely, until 5 seconds set as described above have passed.

For controlling the display as described above, it is preferred to select as the time for display, 12 o'clock a.m. or 1 o'clock a.m. or any suitable time when the display causes little inconvenience to the user or any other persons.

Although in this embodiment, an example of a display control apparatus combined with an electronic cooking range was described, the present invention can also be applied to any suitable apparatus combined with other apparatus such as a video tape recorder, a radio receiver, various control panels and the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus comprising:

a fluorescent display tube comprising a cathode and an anode including a plurality of display segments each having a fluorescent material layer, said plurality of display segments being positioned and configured to cause said display tube to display various characters determined by selection among said display segments, segment enabling means coupled to said fluorescent display tube for selectively supplying operating voltage to said cathode and said plurality of display segments of said anode to cause said fluorescent material layers of said display segments to emit light and display a predetermined character, selection data providing means coupled to said segment enabling means for providing data for selection of said display segments to said segment enabling means, said data for selection having the characteristic that certain specified segments out of all the segments that can be selected are selected relatively less frequently and accordingly said specified segments emit light relatively less frequently, determining timing determining means, and means for enabling some of said segments in response to an output of said predetermined timing determining means, said some of said segments including at least said specified segments emitting light relatively less frequently.

2. A control apparatus in accordance with claim 1, wherein said plurality of display segments constituting said anode are disposed such that a character of a digit can be displayed, and said fluorescent display tube comprises a plurality of anodes so that characters of a plurality of digits can be displayed.

3. A control apparatus in accordance with claim 2, wherein said characters are numerals.

4. A control apparatus in accordance with claim 3, wherein said segment selecting data is data of the remaining time.

5. A control apparatus in accordance with claim 3, further comprising:

means for selecting the remaining time mode or the present time mode, and segment selecting data providing means, the remaining time data being selected in the remaining time mode and the present time data being selected in the present time mode.

6. A control apparatus in accordance with claim 4, wherein said apparatus is combined with an electronically controlled heating apparatus, and said remaining time data is data of the remaining heating time.

7. A control apparatus in accordance with claim 6, wherein said predetermined timing is applied each time the remaining heating time comes to an end.

8. A control apparatus in accordance with claim 5, wherein said apparatus is combined with an electronically controlled heating apparatus, and said remaining time data is data of the remaining heating time.

9. A control apparatus in accordance with claim 8, wherein said anode at least comprise four digits including more significant two digits and less significant two digits for display of numeric data, the arrangement being made such that in said present time mode, hours are represented by said more significant two digits and minutes are represented by said less significant two digits, and in said heating mode, minutes are represented by said more significant two digits and seconds are represented by said less significant two digits.

10. A control apparatus in accordance with claim 9, wherein said predetermined timing is applied each time the remaining heating time comes to an end.

11. A control apparatus in accordance with claim 10, wherein said means for forcedly enabling said segments makes display of: "E" using the most significant digit of said more significant two digits of said anode, "n" using the less significant digit of said more significant two digits, and "d" using the more significant digit of said less significant two digits of said anode, so that said forced display has a meaning by indicating an end of heating as "End".

12. A control apparatus in accordance with claim 8, wherein said predetermined timing is applied at every predetermined time in the present time data.

* * * * *

UNITED STATES PATENT AND TRADEMARK OFFICE

CERTIFICATE OF CORRECTION

PATENT NO. : 4,658,186

DATED : April 14, 1987

INVENTOR(S) : Atsushi Horinouchi

It is certified that error appears in the above-identified patent and that said Letters Patent is hereby corrected as shown below:

On the title page assignee should read

--(73) Assignee: Sanyo Electric Co., Ltd.--.

Signed and Sealed this

Eighteenth Day of August, 1987

*Attest:*

DONALD J. QUIGG

*Attesting Officer*

*Commissioner of Patents and Trademarks*